US005203123A

United States Patent [19]

Travis

[11] Patent Number: 5,203,123

[45] Date of Patent: Apr. 20, 1993

[54] DEFORMABLE SANDING BLOCK

[76] Inventor: Michael L. Travis, Creek Rd., Pleasent Valley, N.Y. 12569

[21] Appl. No.: 500,137

[22] Filed: Mar. 28, 1990

[51] Int. Cl.[5] ..... B24D 17/00

[52] U.S. Cl. ..... 51/358; 51/391

[58] Field of Search ..... 51/358, 363, 391, 392, 51/394, 204 R, 205 R, 211 R, 211 H, 212; 446/374; 76/81, 81.8; 29/78, 79, 80

[56] References Cited

U.S. PATENT DOCUMENTS 1,782,577 11/1930 Maris ..... 51/391
2,392,024 1/1946 Couri ..... 446/374
3,835,598 9/1974 Tobey ..... 51/204 R

*Primary Examiner*—M. Rachuba
*Attorney, Agent, or Firm*—Schmeiser, Morelle & Watts

[57] ABSTRACT

A sanding block having a central metallic core which is deformable yet shape retaining, the core being enclosed totally within an elastomeric covering which is non-abrasive.

7 Claims, 1 Drawing Sheet

DEFORMABLE SANDING BLOCK

FIELD OF THE INVENTION

Generally, this invention relates to the field of supports commonly used for sandpaper which supports are commonly and broadly referred to as sanding blocks. More specifically, this invention is a deformable sandpaper support having an elastomeric outer surface and a deformable, shape retaining metal core.

BACKGROUND OF THE INVENTION

Sanding blocks are presently available in a variety of forms in an attempt to meet the needs of those who must sand various surfaces. Perhaps the most common sandpaper support is a block of wood from which one may move through myriad supports and into complex electric sanders. In virtually all of these items, the general purpose of the sanding block is three fold. First, it allows the user to apply greater pressure to the area being sanded. Secondly, it moves the users hand away from the work surface, usually by providing a handle for the user to grasp, in order to reduce the likelihood of injuries. Thirdly, when a sanding block having a flat sandpaper supporting surface is used to sand a flat surface, the block reduces points of excessive pressure by more evenly distributing the user's force over the sandpaper supporting surface. However, when non-flat surfaces need to be sanded, difficulties often arise. The standard sanding block has a relatively large, flat sandpaper support surface which does not satisfactorily meet the needs of one who is sanding an irregular surface. The use of such a sanding block on a regular surface will generally result in the user angling the block or using it in a way in which it was not intended in an attempt to conform the sanding surface to the work surface. Even with such attempts, the resultant effect is uneven sanding as generally no portion of the block will conform exactly to the area being sanded and excessive areas of pressure which will result in over sanding. Excessive pressure points can also result in the quickened wearing of the sandpaper, such that the sanding block itself may become exposed, which, depending upon the fabrication of the sanding block, may damage the work surface. Similarly, as the user angles the sanding block in order to utilize a corner or edge of the sandpaper; a portion of the block not covered by the sandpaper may scratch the work surface.

In an attempt to provide sanding blocks which are usable on irregular surfaces, a wide variety of devices have been developed. For example, U.S. Pat. No. 3,557,496 to R. W. Martin discloses a metal strap to which a piece of sandpaper may be secured. The strap is then placed over a pipe or other circular type object so that a back and forth motion may be applied to sand the item. A circular piece of sand paper is also secured over the handles which are particularly adapted for sanding the inner edges of the pipes. Other patents disclose devices such as special sandpaper holders for louver doors, U.S. Pat. No. 3,640,031 to Descant; sanding fittings, U.S. Pat. No. 3,722,150 to Pass; abrading corners and crevices as shown in U.S. Pat. No. 2,465,569 issued to Bates. While such devices may be suitable for their intended uses they do not sufficiently meet the myriad surface irregularities often encountered when sanding a complex item.

A common situation where such irregular surfaces are encountered, is in the sanding of automobiles prior to repainting. The problems encountered when sanding an automobile are numerous. For example, some areas of the automobile will provide relatively smooth sloping curves as may often be found on the sides of the automobile. Other sections present small flat surfaces which need to be sanded without scratching the surrounding areas, such as the painted surfaces between tail lights and the like. Other areas present crevices which require sanding both at the bottom and sides, as may be commonly found with the small gutters at the top of the car which are used to drain off water. Complicating this matter is the fact that many of these irregular surface areas abut portions of the automobile that cannot be sanded such as, body molding, light covers, door handles and the like.

Recognizing the need for a more versatile sanding block for such applications, soft sanding blocks have been considered as a possible solution to this problem. However, support surfaces such as foam rubber and the like do not provide sufficient rigidity. Thus, upon the application of pressure sufficient to effectively perform the sanding process pressure points result, creating an unevenly sanded finish. Furthermore, such devices generally secure the sand paper to the block in such a way that only a relatively small portion of the sand paper is usable. This requires additional time and effort as the user must frequently change the sandpaper, and also adds additional cost since the sandpaper, although only partially worn, must be discarded as it no longer provides an abrasive surface when secured to the sanding block.

Thus, an individual faced with the task of sanding a variety of irregular surfaces, must either attempt to use different types of sanding blocks, many of which still will not conform to the actual intended use, or in the alternative, those experienced in this area will use their hand in order to conform and support the sandpaper to the workpiece. Attempting to enhance this latter approach are devices which either secure the sandpaper directly to the users hand or to a specialized glove. It should be easily appreciated that these latter approaches while at times effective, are not reasonable alternatives when a large area needs to be sanded or when sanding is a daily task.

With these difficulties in mind, the applicant began working on various approaches which imitated the versatility found in the human hand without actually using the hand as part of the sandpaper support. This eventually led to the development of the subject invention.

SUMMARY OF THE INVENTION

The subject invention provides a sanding block having characteristics which result in a degree of versatility not heretofore available. The sanding block in a preferred embodiment is ten inches long, two inches wide and one inch thick. The block has a unitary outer layer which is elastomeric and therefore more easily conforms to the surface being sanded and spreads the pressure more evenly over the surface for more uniform sanding. The outer layer is also non-abrasive, being made of silicone rubber, thus protecting the work piece even if the block contacts the work piece directly as is often the case when the sandpaper does not completely envelop the block or should the sandpaper wear through. The outer layer of the block has a sufficiently high co-efficient of friction to also provide secure engagement of the sandpaper. When considered together, these features enable the user to apply the sandpaper to a portion of block while simultaneously utilizing a bare portion of the the block to act as a buffer to prevent the abrasion of adjacent areas. Within the elastomeric sanding block is a metal core which is deformable, yet shape retaining. This allows the user to shape the sanding block and utilize virtually any portion of the block as the support for the sandpaper to be applied to the work product while forming other portions of the block to serve as a handle for easy use.

In addition, the block has wider top and bottom surfaces, and is configured with one of those surfaces forming an outwardly extending arcuate configuration and the otherside of the block being flat. Similarly, the smaller side edges also have one side which is flat and one side which has an outwardly extending arcuate configuration. These features, combined with the bendable versatility of the sanding block, allow the user to configure a wide variety of shapes for particular sanding uses. Also, due to this wide degree of versatility, virtually all portions of the sandpaper may be used, thus, saving time in the sanding process.

By completely enclosing the shape retaining metal insert within the elastomeric material, the item has an increased life span. Should, over a period of time, the metal break due to fatigue, the core will still be maintained within the block and can still be used with almost equal efficiency as elastomeric material, the metal is not likely to push through the block during usage even if the core is broken.

In one version, the metal core is formed from a plurality of small metal rods. This enables the bending of the sanding block in virtually any direction, enhancing the variety of applications possible with the subject invention. Virtually all configurations are functional since, as stated above, by using elastomeric material there is a degree of friction between the back of the sandpaper and the sanding block, such that the sandpaper is sufficiently secured to the block at any location.

Thus, the subject invention overcomes many of the shortcomings of the prior art and provides an improved sanding block which may be used for large, as well as small surfaces, flat and smooth surfaces, and surfaces with irregularities. While the preceding sets forth many of the benefits of the subject invention, a true appreciation of the advantages can only be obtained through working with the invention which will lead to a greater understanding of the versatility and effectiveness of this device.

DETAILED DESCRIPTIONS OF THE DRAWINGS

Figure 1:
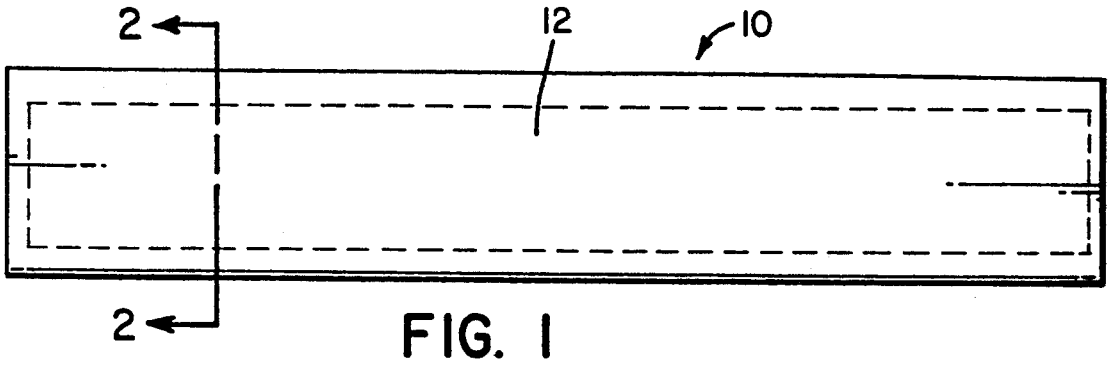
FIG. 1 is a top plan view of the invention showing the metal insert in phantom.

FIG. 1 discloses the sanding block generally designated as 10, also showing in phantom the interior metal core 12. The metal core 12 is a deformable, yet shape retaining piece of metal, which requires from five to twenty-five pounds of force to be bent at its center.

The sanding block 10, in its preferred embodiment, is 10 inches long, 1.5 inches in width and 1 inch thick. However it should be readily appreciated that the size can be varied without departing from the essence of the invention.

Figure 2:
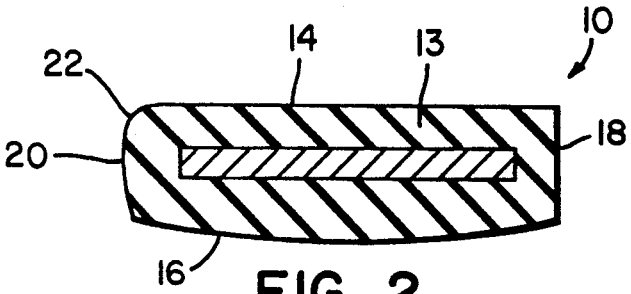
FIG. 2 is a cross sectional view taken along lines 2—2 of FIG. 1.
Figure 4:
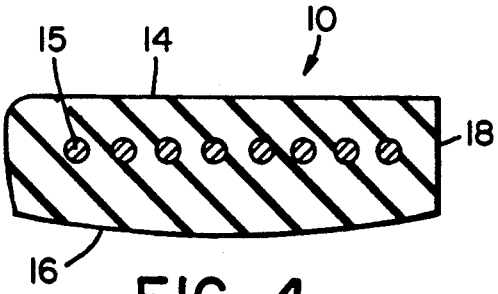
FIG. 4 is a cross sectional view similar to FIG. 2 but showing an alternate embodiment.

As shown in FIG. 2, the block has a unitary body 13, which is made of an elastomeric substance which is non-abrasive. In my preferred embodiment, I use silicone, which is commonly used in caulking and is produced by the General Electric Company, to form the block. Again, however, a variety of silicone rubber or similar substances can be used so long as they has the characteristics of being elastomeric, non-abrasive, and have a sufficient coefficient of friction. The metal insert is approximately ⅛ inch thick and is completely enveloped within the block 10. The thickness of the body from the outer layer to the core is between 0.625 inches and 0.75 inches. The block has a flat top surface 14, and a bottom surface 16. The bottom surface 16 is bent outwardly in a slightly arcuate form. Similarly, a first side 18 is flat and a second side 20 is also bent outwardly in an arcuate form. It should be appreciated that the edge 22, between the flat top surface and the second side, is rounded to provide another support surface of different configuration for supporting the sandpaper on a chosen work surface. It should also be appreciated that the metal core 12 could be a band of metal, as shown in FIG. 2, or could be comprised of a plurality of small metal rods 15 as shown in FIG. 4 which would add greater versatility in bending the sanding block sideways. In either case, the metal core is centrally located so as to prevent the core, even if broken, from extending through the elastomeric body of the block.

Figure 3:
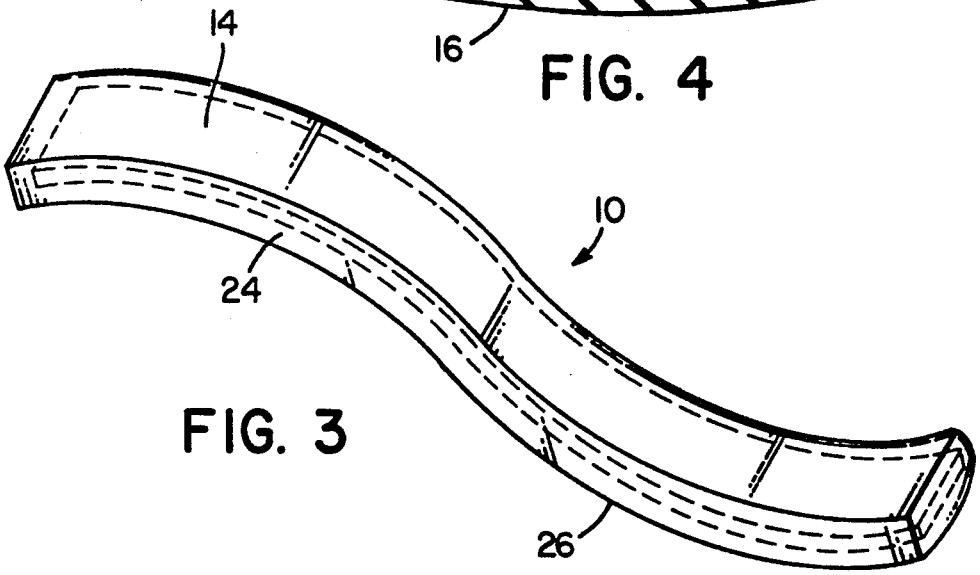
FIG. 3, is a perspective view of the invention showing one possible configuration.

FIG. 3 discloses one of many configurations possible with the subject invention. As shown, the rounded portion 24 can be used as a handle while the lower portion 26 can be used as the support for the sandpaper against the work surface. It would also be possible to simply reverse the block to use the lower portion 26 as the handle and the top surface 14 of the rounded portion 24 as the surface for supporting the sandpaper applied to the work surface. Where large areas need to be sanded, the entire length of the block can be used across the sanding surface. Similarly, crevices which are at all rounded may be sanded with either the edge 22 or the second side 20. Where small flat surfaces need sanding, the first side 18 is most appropriate. Other configurations can be obtained by simply initially conforming the block to the work surface prior to sanding.

It should be appreciated that while the above describes the preferred embodiment of the subject invention variations could be made without departing from the essence of the invention which should be limited only by the appended claims.

I claim:

1. A sanding block comprising:

a unitary body of elastomeric, non-abrasive material capable of flexion and providing a sufficient coefficient of friction at an outer surface thereof to allow for the securement of an abrasive cover for sanding;

a deformable, shape retaining metal core completely enclosed within said body whereby the block may be bent so that a portion of the block conforms to a workpiece and another portion provides a grasping means for a user; and a piece of sandpaper removably wrapped about at least a portion of said outer surface of said unitary body wherein said unitary body functions as a sanding block.

2. The invention of claim 1 wherein said block is elongate, having top and bottom surfaces, and side surfaces, said top and bottom surfaces being wider than the side surfaces and the bottom surface forming an outwardly extending arcuate periphery.

3. The invention of claim 2 wherein one of the side surfaces also has an outwardly extending arcuate periphery.

4. The invention of claim 3 wherein the distance from the core to the outer surface is between 0.625 inches and 0.75 inches.

5. The invention of claim 3 wherein the top surface is substantially flat.

6. The invention of claim 5 wherein one of the side surfaces is substantially flat.

7. The invention of claim 1 wherein the metal core comprises a plurality of metal rods for facilitating a sideward bending of the block.

* * * * *